United States Patent [19]

Chibnik

[11] Patent Number: 4,498,908

[45] Date of Patent: Feb. 12, 1985

[54] LIQUID FUEL COMPOSITION CONTAINING REACTION PRODUCT OF TETRAHYDROPYRIMIDINES

[75] Inventor: Sheldon Chibnik, Cherry Hill, N.J.

[73] Assignee: Mobil Oil Corporation, New York, N.Y.

[21] Appl. No.: 606,562

[22] Filed: May 3, 1984

[51] Int. Cl.[3] ..... C10L 1/22

[52] U.S. Cl. ..... 44/71; 44/67

[58] Field of Search ..... 252/38, 49.7, 42.7, 252/33.6; 44/71, 67

[56] References Cited

U.S. PATENT DOCUMENTS

| | | | |
|---|---|---|---|
| 3,396,106 | 8/1968 | Andress et al. | 252/33.6 |
| 3,642,847 | 2/1972 | Otto et al. | 260/429.9 |
| 4,163,646 | 8/1979 | OudeAlink et al. | 44/77 |
| 4,185,965 | 1/1980 | Schlicht et al. | 44/63 |
| 4,427,562 | 1/1984 | Horodysky et al. | 252/51.5 A |

*Primary Examiner*—William R. Dixon, Jr.
*Assistant Examiner*—C. Johnson
*Attorney, Agent, or Firm*—Alexander J. McKillop; Michael G. Gilman; Van D. Harrison, Jr.

[57] ABSTRACT

3-alkoxy-1 diamines are reacted with a carboxylic acid. The reaction product is further reacted with an inorganic base such as calcium oxide. The product obtained is an additive useful in gasoline to inhibit intake valve deposits and as a dispersant in lubricating compounds.

11 Claims, No Drawings

LIQUID FUEL COMPOSITION CONTAINING REACTION PRODUCT OF TETRAHYDROPYRIMIDINES

RELATED APPLICATIONS

Related U.S. applications are Ser. Nos. 606,563; 606,721; and 606,722, all filed on May 3, 1984, herewith.

NATURE OF THE INVENTION

This invention relates to additive compositions useful in hydrocarbon fuels and lubricants to reduce intake valve deposits.

PRIOR ART

Modern internal combustion engines operating under severe high temperature conditions tend to build up gummy and carbonaceous deposits around the intake valves. These deposits can build up sufficiently to cause partial or total valve sticking. A primary object of this invention therefore is to provide a novel additive material to minimize, avoid or control this problem in such internal combustion engines.

U.S. Pat. No. 4,163,646 discloses the hydrogenation of tetrahydropyrimidines to yield linear N-substituted diamines which can be reacted with carbonyls to form imines, which imines can be reduced to N,N'-substituted diamines. These products are stated to be useful as fuel additives.

U.S. Pat. No. 4,185,965 discloses motor fuel compositions containing dihydroimidazoline, tetrahydropyrimidine and amide derivatives of hydrocarbyl substituted lactam acids.

U.S. Pat. No. 3,396,106 discloses lubricants and liquid hydrocarbon fuels containing a mixture of a di-substituted tetrahydropyramidine and an amine salt of a succinamic acid.

The reaction of a carboxylic acid with a 1,3-diamine to make tetrahydropyramidines is well known and numerous examples of the products of reaction between long-chain carboxylic acids and polyalkylene amines have been cited as fuel and lubricant detergent/dispersing additives.

SUMMARY OF THE INVENTION

In accordance with the present invention, 3-alkoxy-1,3 diamines are reacted with a carboxylic acid to form a reaction product thought to consist primarily of tetrahydropyrimidines. This product subsequently is reacted with an excess of an inorganic base. The reaction product thus obtained is the additive material which is added to liquid fuels such as gasoline, to function as an intake valve deposit inhibitor. In lube oils, greases and other functional fluids the reaction product functions well as a dispersant.

DESCRIPTION OF THE INVENTION

The 3-alkoxy-1,3 diamines utilized in making the additive composition of this invention generally have the structure as follows:

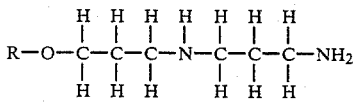

wherein the alkoxy component, RO, can be from 1 to 70 carbon atoms in length. Particularly preferred diamines are (3-tridecyloxypropyl)-1,3-propylenediamine and a commercial mixture, $ROCH_2CH_2CH_2NHCH_2CH_2NH_2$, where R is an alkyl substituent of 12 to 15 carbon atoms.

The carboxylic acids with which the 1,3 diamines are reacted are long-chain mono- or polycarboxylic acids, as well as naphthenic and alkylaromatic. There is no particular limit on the size of the chain as long as the carboxylic acid is soluble in hydrocarbons. It should also be noted that the corresponding acid derivatives such as esters or amine salts can be used in place of the acid.

A preferred carboxylic acid is isostearic acid.

Ordinarily the 1,3 diamine and carboxylic acid will be reacted in a mole ratio of between 1:1 and 1:2 of diamine to carboxylic acid at a temperature of 100° to 300° C. in a non-reactive atmosphere. Preferably a solvent is used, such as toluene, to effect azeotropic removal of the water formed. The period of reaction can be as long as three hours. Following this, the reaction product obtained is further reacted with an inorganic base at a temperature of 175° to 350° C. to provide the final reaction product of this invention. Preferably the mole ratio of inorganic base to reaction product is between 1:1 and 5:1 based on the original moles of carboxylic acid used. Of the inorganic bases available calcium oxide is preferred because of its price and availability. Barium or strontium oxides can also be used. The reaction product then obtained is separated and utilized as the additive composition of this invention. The reaction product will be in a liquid form ordinarily and can be purified by filtering and/or decantation.

The final reaction product is used as an additive in this invention in any one of the wide variety of available oils of lubricating viscosity, such as natural, refined or synthetic oils, in blends of such oils, or in greases made therefrom.

These oils may be prepared with or without auxiliary conventional additives such as oiliness and extreme pressure agents, corrosion, oxidation and rust inhibitors; viscosity index improving agents; coloring agents and auxiliary detergents. The useful oils include mineral oils, both naphthenic and paraffinic, either or both containing aromatic fractions. They include among the synthetic oils the synthetic hydrocarbon oils, as well as synthetic ester oils prepared from, for example, monohydric alcohols and polyfunctional acids or from the polyhydric alcohols and monofunctional acids. In this latter category are esters prepared from pentaerythritol and a $C_5$ aliphatic mono acid such as valeric acid or from such alcohol and a mixture of $C_5$–$C_9$ aliphatic monofunctional acids.

The fuels combined with the additive of this invention are liquid hydrocarbon combustion fuels, including the distillate fuels, i.e., gasoline and fuel oils. Accordingly, the fuel oils that may be improved in accordance with the present invention are hydrocarbon fractions having an initial boiling point of at least about 100° F. and an end-boiling point no higher than about 750° F. and boiling substantially continuously throughout their distillation range. These fuel oils are generally known as distillate fuel oils. It is to be understood, however, that this term is not restricted to straight run distillate fractions. The distillate fuel oils can be straight run distillate fuel oils, catalytically or thermally cracked (including hydrocracked) distillate, fuel oils, or mixtures of straight run distillate fuel oils, naphthas and the like, with cracked distillate stocks. Moreover, such fuel oils can be treated in accordance with well known commercial methods, including acid or caustic treatment, hydrogenation, solvent refining, clay treatment and the like. The distillate fuel oils are characterized by their relatively low viscosities, pour points, and similar properties. The principal property which characterizes the contemplated hydrocarbons, however, is the distillation range. As mentioned hereinbefore, this range lies between about 100° F. and about 750° F. Obviously, the distillation range of each individual fuel oil will cover a narrower boiling range, but falling, nevertheless, within the above specified limits. Likewise, each fuel oil with boil substantially continuously throughout its distillation range. Contemplated among the fuel oils are numbers 1, 2 and 3 fuel oils (useful in heating and in diesel engines) and the jet combustion fuels. The domestic fuel oils generally conform to the specifications set forth in A.S.T.M. Specifications D396-48T. Specifications for diesel fuels are defined in A.S.T.M. Specification D975-48T. Typical jet fuels are defined in Military Specification MIL-F-5624B.

The gasolines that are improved by the additive compositions of this invention are mixtures of hydrocarbons having an initial boiling point falling between about 75° F. and about 135° F. and an end-boiling point falling between about 250° F. and about 450° F. As is well known, in the art, motor gasoline can be straight run gasoline or, as is more usual, it can be a blend of two or more cuts of materials including straight run stock, catalytic or thermal reformate, cracked stock, alkylated natural gasoline and aromatic hydrocarbons. All of these are contemplated.

If the additive compositions of this invention are to be incorporated into a lubricating oil they are added in a concentration of between 0.5 and 15 percent. If the composition is to be incorporated into a fuel such as distillate or gasoline the concentration is between 1 and 200 pounds per thousand barrels.

EXAMPLES

In the tests described below a hot plate test was used. In these tests one part of additive was combined with three parts of a mixture of used engine oil and a heavy gasoline and heated to 260°-316° C. for one hour. The residue is then soaked in gasoline for 16 hours and the remaining deposits are weighed. This test has been found to correlate well with the amount of intake valve deposits in certain automobile engines. The base test mixture without additive leaves 2.3% residue.

EXAMPLE 1

A commercially available diamine, (3-tridecyloxypropyl)-1,3-propylenediamine, (62.3 grams, 0.185 moles) and isostearic acid (54.4 grams, 0.185 moles) were heated in a flask for three hours under a nitrogen gas atmosphere, together with sufficient xylene to effect azeotropic removal of the water formed at 275° C. A sample taken at this time showed a small infrared absorption peak at 1540 $cm^{-1}$ and left a 4.9% residue in the hot plate test. Calcium oxide (31.2 grams, 0.557 moles) was then added and heating was continued for an additional three hours. The solvent was stripped and the product was filtered. A new strong infra-red absorption peak was noted at 1570 $cm.^{-1}$ and the 1540 $cm.^{-1}$ peak was no longer present. The hot plate residue amounted to 0.1%.

EXAMPLE 2

This example illustrates that the 1,3-polyalkylene polyamines or alkyl 1,3-diamines do not work well in making the additive of this invention.

Under the same conditions, as in Example 1 a 1/1 mole ratio of isostearic acid and N-aminopropyl oleylamine were reacted to prepare materials described in the examples of one component of U.S. Pat. No. 3,396,106. This material showed a small infra-red absorption peak at 1540 $cm.^{-1}$ and no peak at 1570. No changes were noted when this material was treated with calcium oxide as in Example 1. The hot plate residue was 6.4%.

EXAMPLE 3

This example illustrates that known lubricant additives prepared from polyalkylene polyamines do not work as well as the additives of this invention. Under the same conditions as previous examples, isostearic acid (105.3 grams, 0.34 mols) was reacted with tetraethylenepentamine (32 grams, 0.17 mols). The reaction products showed no significant changes in infra-red absorption after calcium oxide treatment and left a 3.9% residue in the hot plate test.

EXAMPLE 4

Under the same conditions as in Example 1, 0.15 moles of $ROCH_2CH_2CH_2NHCH_2CH_2NH_2$ (a commercial mixture in which $R=C_{12}$ to $C_{15}$) was reacted with 0.3 moles of isostearic acid. The same changes were noted in the infra-red spectrascopic tests, and the hot plate performance test improved from 6.2% residue before treatment with 1.4 moles of calcium oxide to 0.1% after treatment.

What is claimed is:

1. A fuel composition containing a major portion of a liquid fuel and between about 1 and about 200 pounds of additive per 1000 barrels of liquid fuel, said additive having been prepared by:

(a) reacting a diamine or mixture of diamines generally having the structural formula:

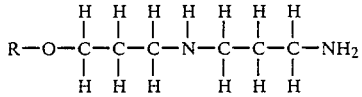

wherein R is 1 to 70 carbon atoms in length, with a monocarboxylic or dicarboxylic acid, in a mole ratio of diamine to acid of between about 1:1 and about 1:2 at a temperature of about 100° to about 300° C.; and thereby obtaining a tetrahydropyrimidine reaction product; and (b) reacting the tetrahydropyrimidine reaction product of (a) with an inorganic base, in a mole ratio of base to acid at between about 1:1 and about 5:1 at a temperature of about 175° to about 350° C. thereby obtaining said additive.

2. The composition of claim 1 wherein said diamine is (3-tridecyloxypropyl)-1,3-propylenediamine.

3. The composition of claim 1 wherein said diamine is a mixture of amines of the formula $$ROCH_2CH_2CH_2NHCH_2CH_2CH_2NH_2$$

where R is an alkyl substituent of 12-15 carbon atoms.

4. The composition of claim 1 wherein the acid of (a) is a monocarboxylic acid.

5. The composition of claim 1 wherein the acid of (a) is a dicarboxylic acid.

6. The composition of claim 1 wherein the acid of (a) is a naphthenic acid.

7. The composition of claim 1 wherein the acid of (a) is an alkyl succinic acid.

8. The composition of claim 1 wherein the inorganic base of (b) is an oxide of a metal selected from Group IA and IIA of the Periodic Table.

9. The composition of claim 1 wherein the inorganic base of (b) is calcium oxide.

10. A fuel composition containing a major portion of a liquid fuel and between about 1 and about 200 pounds of additive per 1000 barrels of liquid fuel, said additive having been prepared by:

(a) reacting a diamine or mixture of diamines generally having the structural formula:

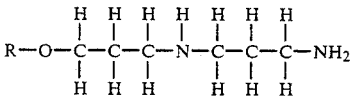

wherein R is 1 to 70 carbon atoms in length, with the amine salt of a moncarboxylic or dicarboxylic acid in a mole ratio of amine salt to acid of between about 1:1 and about 1:2 at a temperature of about 100° to about 300° C. thereby obtaining a tetrahydropyrimidine reaction product; and (b) reacting the tetrahydropyrimidine reaction product of (a) with an inorganic base in a mole ratio of base to acid of between about 1:1 and about 5:1 at a temperature of about 175° to about 350° C., thereby obtaining said additive.

11. A fuel composition containing a major portion of a liquid fuel and between about 1 and about 200 pounds of additive per 1000 barrels of liquid fuel, said additive having been prepared by:

(a) reacting a diamine or mixture of diamines generally having the structural formula:

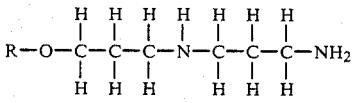

wherein R is 1 to 70 carbon atoms in length, with the ester of a moncarboxylic or dicarboxylic acid in a mole ratio of ester to acid of between about 1:1 and about 1:2 at a temperature of about 100° to about 300° C.; thereby obtaining a tetrahydropyrimidine reaction product; and (b) reacting the tetrahydropyrimidine reaction product of (a) with an inorganic base in a mole ratio of base to acid of between about 1:1 and about 5:1 at a temperature of about 175° to about 350° C., thereby obtaining said additive.

* * * * *